US006527098B2

(12) United States Patent
Krampl

(10) Patent No.: US 6,527,098 B2
(45) Date of Patent: Mar. 4, 2003

(54) ESCALATOR OR MOVING WALKWAY WITH SUPPORT STRUCTURE

(75) Inventor: David Krampl, Vienna (AT)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 10/186,542

(22) Filed: Jul. 1, 2002

(65) Prior Publication Data

US 2003/0000800 A1 Jan. 2, 2003

(30) Foreign Application Priority Data

Jul. 2, 2001 (EP) ..... 01810639

(51) Int. Cl.[7] ..... B66B 23/00
(52) U.S. Cl. ..... 198/326; 198/321
(58) Field of Search ..... 198/321, 326

(56) References Cited

U.S. PATENT DOCUMENTS 2,794,531 A * 6/1957 Stelzer ..... 198/321
4,260,318 A * 4/1981 Holritz et al. ..... 414/589
4,832,169 A * 5/1989 Goto ..... 198/326
6,105,748 A * 8/2000 Pallinger et al. ..... 198/321
6,374,981 B1 * 4/2002 Gschwendtner ..... 198/321

FOREIGN PATENT DOCUMENTS

JP 2-127388 * 5/1990 ..... 198/321
JP 4-148790 * 5/1992 ..... 198/321

* cited by examiner

*Primary Examiner*—Douglas Hess
(74) *Attorney, Agent, or Firm*—Schweitzer Cornman Gross & Bondell LLP

(57) ABSTRACT

An escalator or moving walkway includes a support structure supported between the rests at a cable, which is arranged laterally or below the support structure. According to the invention there is provided in the region of each rest a respective lever which is rotatably mounted at the support structure and is slidingly supported by one arm at the building structure, the cable being fastened to the other arm of the lever so that the cable is additionally tensioned when the support structure bends. In this manner, the construction is very stiff so that the escalator bends only slightly even under heaving loading.

6 Claims, 1 Drawing Sheet

ESCALATOR OR MOVING WALKWAY WITH SUPPORT STRUCTURE

The present invention relates to an escalator or moving walkway with at least one support structure supported between a cable, which is arranged as an auxiliary support structure laterally or below the support structure. Such a cable may also be termed "under-bracing".

BACKGROUND OF THE INVENTION

Such an escalator or such a moving walkway is known from EP 866019 A1. By virtue of the cable under-bracing a support structure can be constructed to bridge over longer spans, or a given support structure can be dimensioned less strongly for a given span, so that the escalator or moving walkway appears more slender.

A disadvantage to such a known construction is that, when the support structure bends as a result of loading, the cable stretches as it supports a greater proportion of the load, and thus cannot sufficiently counteract the bending deflections. However, only small bending deflections are normally permissible. Because otherwise disturbances arise in the mechanical system of the escalator or moving walkway.

It is the object of the present invention to develop an escalator or a moving walkway of the kind stated in the introduction in such a manner that the supporting effect of the overall construction is increased, i.e. bends less under load.

BRIEF DESCRIPTION OF THE INVENTION

According to the invention this object is met by an escalator or a moving walkway of the kind stated in the introduction in which the region of each rest there is provided a respective lever which is rotatably mounted at the support structure and which is slidingly supported by one arm at the building structure, the cable being fastened to another arm of the lever so that the cable is additionally tensioned with increasing loading (useful load) and thereby increases the supporting effect.

Since the cable is tensioned more strongly when the support structure is loaded, the tension in the cable is increased so that the main support structure is raised relatively at the cable support points.

BRIEF DESCRIPTION OF THE DRAWING

Further features and advantages of the invention are evident from the following description of an illustrative embodiment with reference to the accompanying drawings, in which.

DETAILED DESCRIPTION OF THE INVENTION

Figure 1:
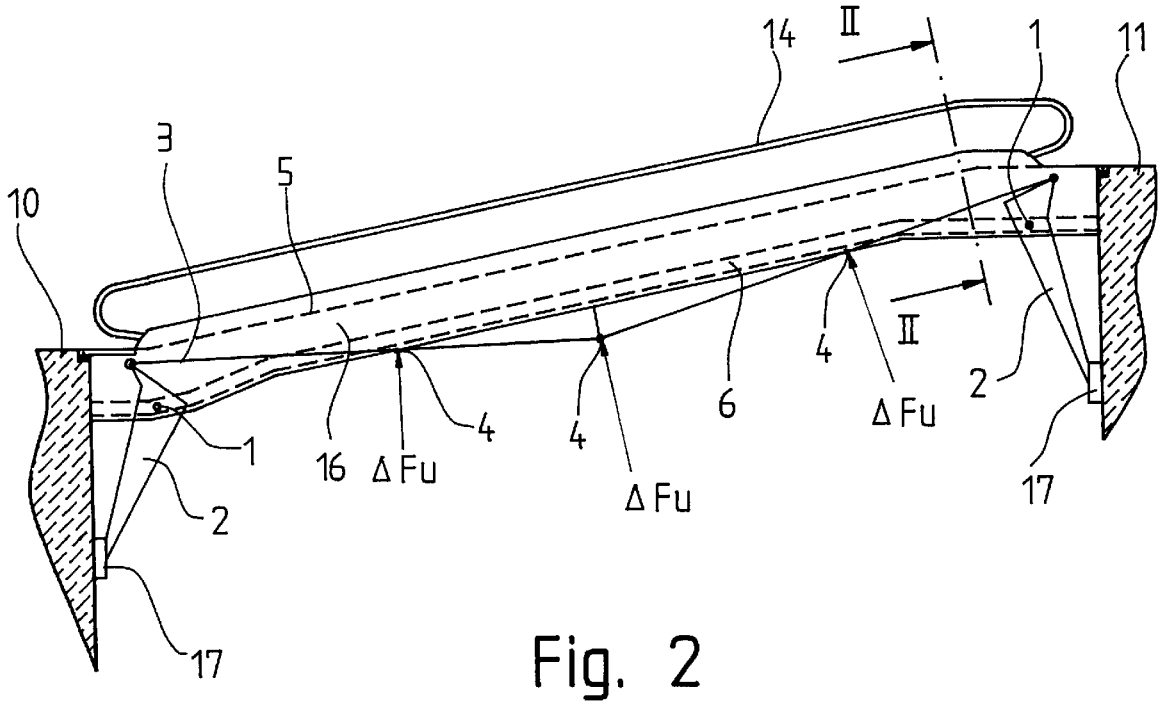
FIG. 1 is a side elevation view of a moving walkway according to the invention.

A moving walkway as depicted in the Figures connects a first story with a second story. It bears by way of rests (not illustrated) on the respective story floor 10 or 11. The moving walkway is bounded laterally by balustrades 12, 13, for example of glass, which carry handrails 14, 15 at their tops. Disposed at both sides of the moving walkway is, as usual, a support structure 16 which is constructed as a framework with an upper boom 5 and a lower boom 6. A respective lever 2 is mounted at each of the ends of the support structure at the point 1, and, in particular, at the lower boom 6 or in the vicinity thereof. This lever 2 is supported by way of a slide bearing 17, which can be constructed as a damping plate, at the respective story floor 10 or 11. A respective end of a cable 3 is fastened to the other end of each lever 2, and is connected to the support structure at the support points 4. The cable 3 serves as an under-bracing.

The present invention functions as follows: if the moving walkway is strongly loaded, the support structure begins to bend. This bending is counteracted by the cable 3, on which the support structure 16 is supported at support points 4. The cable is thereby additionally loaded, so that it stretches somewhat. Due to the bending deflection of the support structure 16, the lower boom 6 stretches and the upper boom 5 shortens. The points 1, which lie at the lower boom, therefore creep somewhat apart, i.e. in each case in a direction towards the adjacent story floor 10 or 11. The lower ends of the levers 2 thereby slide in the slide bearings 17 somewhat downwardly and the two levers 2 rotate so that the upper ends thereof move more strongly in the direction towards the respective storey floor 10 or 11 than the points 1. The cable 3 is thereby tensioned, whereby an additional support force $\Delta Fu$ acts at the support points.

Figure 2:
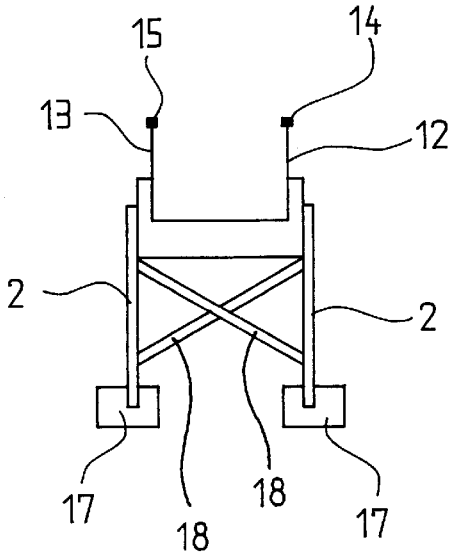
FIG. 2 is a section view taken along the line II—II in FIG. 1.

In total, four levers 2 of that kind may be present, namely two at each of the sides of the moving walkway; at the upper end and the lower end. The construction can be laterally stabilized by diagonal struts 18 (see FIG. 2).

I claim:

1. An escalator or moving walkway, comprising an escalator or moving walkway supported on a support structure having opposed ends supported by rests of a building structure: first and second levers rotatably mounted to the support structure proximate the ends thereof, each of the levers having a first arm slidingly supported by the building structure, and a tensioned supporting cable extending between second arms of the levers, whereby the cable is additionally tensioned by a pivoting action of the levers with increasing load to increases the cable's supporting effect to reduce bending of the support structure.

2. The escalator or moving walkway of claim 1 wherein a portion of the cable extends below the support structure.

3. The escalator or moving walkway of claim 1 wherein a portion of the cable is located laterally of the support structure.

4. The escalator or moving walkway of claim 1 wherein the cable is connected to the support structure at a point between the second arms of the levers.

5. The escalator or moving walkway of claim 1 wherein the first and second levers are located along a side of the support structure.

6. The escalator or moving walkway of claim 5 further comprising a second pair of first and second levers located along a second side of the support structure and a second tensioned supporting cable extending between second arms thereof.

* * * * *